US009967647B2

(12) United States Patent
Kumar et al.

(10) Patent No.: US 9,967,647 B2
(45) Date of Patent: May 8, 2018

(54) OFF-EAR AND ON-EAR HEADPHONE DETECTION

(71) Applicant: Avnera Corporation, Beaverton, OR (US)

(72) Inventors: Amit Kumar, Portland, OR (US); Eric Sorensen, Portland, OR (US); Shankar Rathoud, Beaverton, OR (US)

(73) Assignee: Avnera Corporation, Beaverton, OR (US)

( * ) Notice: Subject to any disclaimer, the term of this patent is extended or adjusted under 35 U.S.C. 154(b) by 45 days.

(21) Appl. No.: 14/850,859

(22) Filed: Sep. 10, 2015

(65) Prior Publication Data

US 2017/0013345 A1 Jan. 12, 2017

Related U.S. Application Data

(60) Provisional application No. 62/190,864, filed on Jul. 10, 2015.

(51) Int. Cl.

| | |
|---|---|
| ***H04R 1/10*** | (2006.01) |
| ***G10K 11/178*** | (2006.01) |
| *H04R 3/00* | (2006.01) |
| *H04R 29/00* | (2006.01) |

(52) U.S. Cl.

CPC ..... *H04R 1/1041* (2013.01); *G10K 11/178* (2013.01); *G10K 11/1788* (2013.01); *G10K 2210/1081* (2013.01); *G10K 2210/3021* (2013.01); *H04R 1/1083* (2013.01); *H04R 3/00* (2013.01); *H04R 29/00* (2013.01); *H04R 2410/05* (2013.01); *H04R 2460/03* (2013.01)

(58) Field of Classification Search

CPC ..... H04R 1/1041; H04R 2460/03; H04R 1/1083; H04R 2410/05; H04R 29/00; H04R 3/00; G10K 11/1788; G10K 2210/1081; G10K 2210/3021

USPC ..... 381/74, 71.1, 71.11, 71.14, 94.1, 95, 381/94.9, 309, 370, 58, 71.6, 71.8

See application file for complete search history.

(56) References Cited

U.S. PATENT DOCUMENTS

| | | | | |
|---|---|---|---|---|
| 6,118,878 A * | 9/2000 | Jones | G10K 11/178 381/71.11 |
| 2009/0154720 A1* | 6/2009 | Oki | H04R 1/1041 381/74 |
| 2015/0078573 A1 | 3/2015 | Nicholson | |

(Continued)

*Primary Examiner* — Paul S Kim
*Assistant Examiner* — Friedrich W Fahnert
(74) *Attorney, Agent, or Firm* — Marger Johnson

(57) ABSTRACT

A headphone detector including a headphone and a processor. The headphone has a microphone and a speaker, and the microphone is configured to generate an audio signal based on an output of the speaker. The processor is configured to receive the audio signal, determine a characteristic of the audio signal, and assess whether the headphone is on ear or off ear based on a comparison of the characteristic to a threshold. In another aspect, an off-ear detection (OED) system includes a headphone and an OED processor. The headphone has a speaker, a feedforward microphone, and a feedback microphone. The OED processor is configured to determine whether the headphone is off ear or on ear, based at least in part on a headphone audio signal, a feedforward microphone signal, and a feedback microphone signal.

22 Claims, 3 Drawing Sheets

(56) References Cited

U.S. PATENT DOCUMENTS

| | | | | |
|---|---|---|---|---|
| 2015/0104031 | A1* | 4/2015 | Park | G10K 11/1788 381/71.6 |
| 2015/0124977 | A1* | 5/2015 | Srivastava | H04R 25/305 381/58 |
| 2015/0195639 | A1 | 7/2015 | Azmi et al. | |
| 2015/0195646 | A1 | 7/2015 | Kumar et al. | |

* cited by examiner

OFF-EAR AND ON-EAR HEADPHONE DETECTION

CROSS-REFERENCES TO RELATED APPLICATIONS

This patent application claims the benefit of provisional Application No. 62/190,864 filed Jul. 10, 2015, which is incorporated into this patent application by this reference in its entirety.

FIELD OF THE INVENTION

This disclosure is related to audio processing and, more particularly, to a device and method for detecting whether or not audio headphones are being worn by a user, as well as using such information to control features.

BACKGROUND

Active noise cancellation (ANC) is a conventional method of reducing an amount of undesired noise received by a user listening to audio through headphones. The noise reduction is typically achieved by playing an anti-noise signal through the headphone's speakers. The anti-noise signal is an approximation of the negative of the undesired noise signal that would be in the ear cavity in the absence of ANC. The undesired noise signal is then neutralized when combined with the anti-noise signal.

In a general noise-cancellation process, one or more microphones monitor ambient noise or residual noise in the ear cups of headphones in real-time, then the speaker plays the anti-noise signal generated from the ambient or residual noise. The anti-noise signal may be generated differently depending on factors such as physical shape and size of the headphone, frequency response of the speaker and microphone transducers, latency of the speaker transducer at various frequencies, sensitivity of the microphones, and placement of the speaker and microphone transducers, for example.

In feedforward ANC, the microphone senses ambient noise but does not appreciably sense audio played by the speaker. In other words, the feedforward microphone does not monitor the signal directly from the speaker. In feedback ANC, the microphone is placed in a position to sense the total audio signal present in the ear cavity. So, the microphone senses the sum of both the ambient noise as well as the audio played back by the speaker. A combined feedforward and feedback ANC system uses both feedforward and feedback microphones.

Typical ANC headphones are powered systems that require a battery or another power source to operate. A commonly encountered problem with powered headphones is that they continue to drain the battery if the user removed the headphones without turning them off.

While some conventional headphones detect whether a user is wearing the headphones, these conventional designs rely on mechanical sensors, such as a contact sensor or magnets, to determine whether the headphones are being worn by the user. Those sensors would not otherwise be part of the headphone. Instead, they are an additional component, perhaps increasing the cost or complexity of the headphone.

Embodiments of the invention address these and other issues in the prior art.

SUMMARY OF THE DISCLOSURE

Embodiments of the disclosed subject matter use a microphone in a headphone, such as an automatic noise canceling (ANC) headphone, as part of a detection system to determine if the headphone is positioned on a user's ear.

Accordingly, at least some embodiments of a headphone detector may include a headphone and a processor. The headphone has a microphone and a speaker, and the microphone is configured to generate an audio signal based on an output of the speaker. The processor is configured to receive the audio signal, determine a characteristic of the audio signal, and assess whether the headphone is on ear or off ear based on a comparison of the characteristic to a threshold.

In another aspect, at least some embodiments of an off-ear detection (OED) system may include a headphone and an OED processor. The headphone has a speaker, a feedforward microphone, and a feedback microphone. The speaker is configured to transmit an audio playback signal based on a headphone audio signal. The feedforward microphone is configured to sense an ambient noise signal and transmit a feedforward microphone signal based at least in part on the ambient noise signal. The feedback microphone is configured to sense a total audio signal and transmit a feedback microphone signal based at least in part on the total audio signal, in which the total audio signal is the sum of the audio playback signal and at least a portion of the ambient noise level. The OED processor is configured to receive the headphone audio signal, the feedforward microphone signal, and the feedback microphone signal. The OED processor is also configured to determine whether the headphone is off ear or on ear, based at least in part on the headphone audio signal, the feedforward microphone signal, and the feedback microphone signal.

In yet another aspect, at least some embodiments of a method of detecting whether a headphone is off ear or on ear may include generating an audio signal based on an output of a speaker of a headphone; receiving, at a processor, the audio signal; determining, with the processor, a characteristic of the audio signal; and assessing, by the processor, whether the headphone is on ear or off ear by comparing the characteristic to a threshold.

In still another aspect, at least some embodiments of a method of detecting whether a headphone is off ear or on ear may include producing an acoustic signal at a headphone based at least in part on a received headphone audio signal; generating, at the headphone, a feedforward microphone signal and a feedback microphone signal, in which the feedback microphone signal is based at least in part on the acoustic signal; determining, with the processor, a characteristic of the headphone audio signal, a characteristic of the feedforward microphone signal, and a characteristic of the feedback microphone signal; and assessing, with the processor, whether the headphone is off ear or on ear based at least in part on the characteristic of the headphone audio signal, the characteristic of the feedforward microphone signal, and the characteristic of the feedback microphone signal.

DETAILED DESCRIPTION

In general, the device and methods according to embodiments of the invention use at least one microphone in an automatic noise canceling (ANC) headphone as part of a detection system to automatically determine if the headphone is positioned on a user's ear. The detection system does not typically include a separate sensor, such as a mechanical sensor, although in some embodiments a separate sensor could also be used.

If the detection system determines that the headphones are not being worn, steps may be taken to reduce power consumption or implement other convenience features, such as sending a signal to turn off the ANC feature, turn off parts of the headphone, turn off the entire headphone, or pause or stop a connected media player. If the detection system instead determines that the headphones are being worn, such a convenience feature might include sending a signal to start or restart the media player. Other features may also be controlled by the sensed information.

Figure 1A:
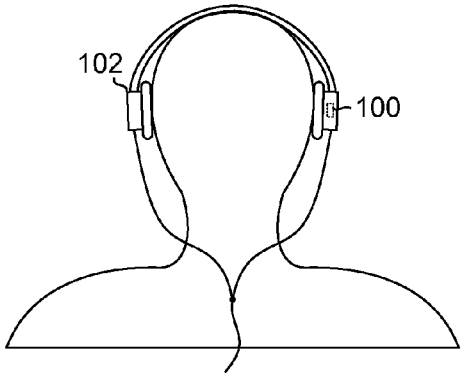
FIG. 1A shows an embodiment of an off-ear detector integrated into a headphone, which is depicted as being on ear, according to an embodiment of the invention
Figure 1B:
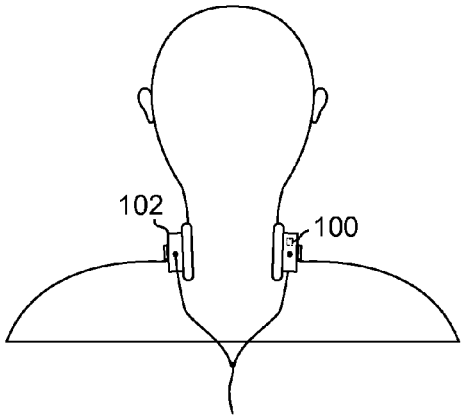
FIG. 1B shows the embodiment of the off-ear detector of FIG. 1A depicted as being off ear.

The terms "being worn" and "on ear" as used in this disclosure mean that the headphone is in or near its customary in-use position near the user's ear or eardrum. Thus, for pad- or cup-style headphones, "on ear" means that the pad or cup is completely, substantially, or at least partially over the user's ear. An example of this is shown in FIG. 1A. For earbud-type headphones and in-ear monitors, "on ear" means that the earbud is at least partially, substantially, or fully inserted into the user's ear. Accordingly, the term "off ear" as used in this disclosure means that the headphone is not in or near its customary in-use position. An example of this is shown in FIG. 1B, in which the headphones are being worn around the user's neck.

The disclosed apparatus and method are suitable for headphones that are used in just one ear or in both ears. Additionally, the OED apparatus and method may be used for in-ear monitors and earbuds. Indeed, the term "headphone" as used in this disclosure includes earbuds, in-ear monitors, and pad- or cup-style headphones, including those whose pads or cups encompass the user's ear and those whose pads press against the ear.

In general, when the headphones are off ear, there is not a good acoustic seal between the headphone body and the user's head or ear. Consequently, the acoustic pressure in the chamber between the ear or eardrum and the headphone speaker is less than the acoustic pressure that exists when the headphone is being worn. In other words, the audio response from an ANC headphone is relatively weak at low frequencies unless the headphone is being worn. Indeed, the difference in audio response between the on-ear and the off-ear conditions can be more than 20 dB at very low frequencies.

Additionally, the passive attenuation of ambient noise when the headphone is on ear, due to the body and physical enclosure of the headphone, is significant at high frequencies, such as those above 1 kHz. But at low frequencies, such as those less than 100 Hz, the passive attenuation may be very low or even negligible. In some headphones, the body and physical enclosure actually amplifies the low ambient noise instead of attenuating it.

Also, in the absence of an activated ANC feature, the ambient noise waveform at the feedforward and feedback microphones are: (a) deeply correlated at very low frequencies, which are generally those frequencies below 100 Hz; (b) completely uncorrelated at high frequencies, which are generally those frequencies above 3 kHz; and (c) somewhere in the middle between the very low and the high frequencies.

These acoustic features provide bases for determining whether or not a headphone is on ear for embodiments of the invention.

FIG. 1A shows an embodiment of an off-ear detector 100 integrated into a headphone 102 as an example implementation. The headphone 102 in FIG. 1A is depicted as being worn, or on ear. FIG. 1B shows the off-ear detector 100 of FIG. 1A, except the headphone 102 is depicted as being off ear. The off-ear detector 100 may be present in the left ear, the right ear, or both ears.

Figure 2:
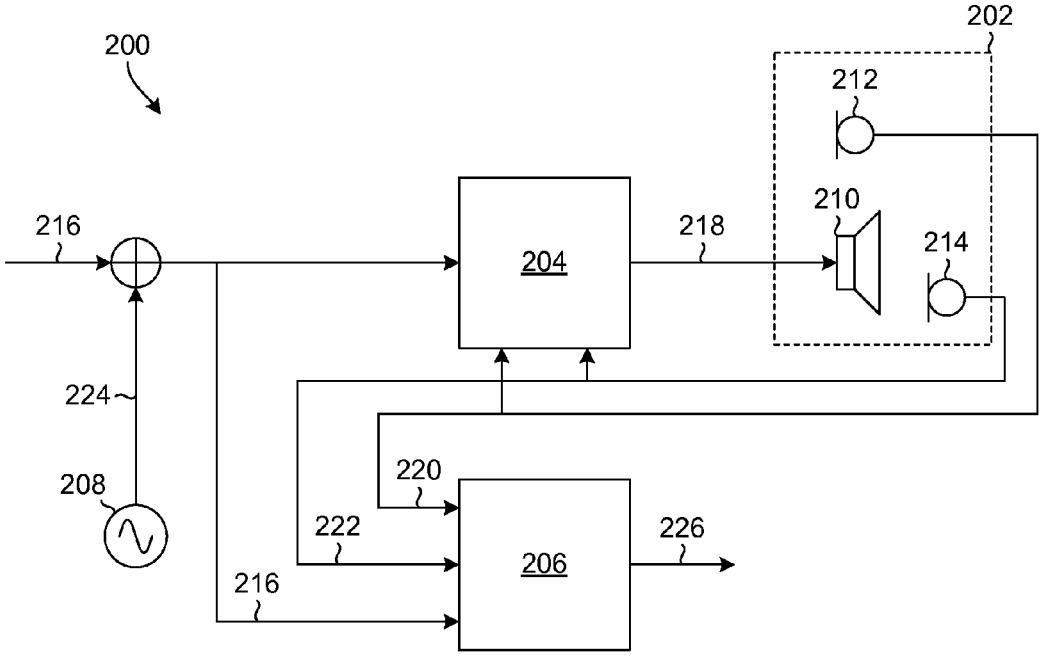
FIG. 2 is a functional block diagram showing components of an off-ear detection system according to an embodiment of the invention.

FIG. 2 is a functional block diagram showing components of an embodiment of an off-ear detection system 200, which may be an embodiment of the off-ear detector 100 of FIGS. 1A and 1B. An embodiment, such as shown in FIG. 2, may include a headphone 202, an ANC processor 204, an OED processor 206, and a tone source, which may be a tone generator 208. The headphone 202 may further include a speaker 210, a feedforward microphone 212, and a feedback microphone 214.

Although likely present for the ANC features of an ANC headphone, the ANC processor 204, the speaker 210, and the feedforward microphone 212 are not absolutely required in some embodiments of the off-ear detection system 200. The tone generator 208 is also optional, as discussed below.

Embodiments of the off-ear detection system 200 may be implemented as one or more components integrated into the headphone 202, one or more components connected to the headphone 202, or software operating in conjunction with an existing component or components. For example, software driving the ANC processor 204 might be modified to implement embodiments of the off-ear detection system 200.

The ANC processor 204 receives a headphone audio signal 216 and sends an ANC-compensated audio signal 218 to the headphone 202. The feedforward microphone 212 generates a feedforward microphone signal 220, which is received by the ANC processor 204 and the OED processor 206. The feedback microphone 214 likewise generates a feedback microphone signal 222, which is received by the ANC processor 204 and the OED processor 206. The OED processor 206 also receives the headphone audio signal 216. Preferably, the OED tone generator 208 generates a tone signal 224 that is injected into the headphone audio signal 216 before the headphone audio signal 216 is received by the OED processor 206 and the ANC processor 204. In some embodiments, though, the tone signal 224 is injected into the headphone audio signal 216 after the headphone audio signal 216 is received by the OED processor 206 and the ANC processor 204. The OED processor 206 outputs a decision signal 226 indicating whether or not the headphone 202 is being worn, which is described more fully in reference to FIG. 3 below.

The headphone audio signal 216 is a signal characteristic of the desired audio to be played through the headphone's speaker 210 as an audio playback signal. Typically, the headphone audio signal 216 is generated by an audio source such as a media player, a computer, a radio, a mobile phone, a CD player, or a game console during audio play. For example, if a user has the headphone 202 connected to a portable media player playing a song selected by the user, then the headphone audio signal 216 is characteristic of the song being played. The audio playback signal is sometimes referred to in this disclosure as an acoustic signal.

Typically, the feedforward microphone 212 samples an ambient noise level and the feedback microphone 214 samples the output of the speaker 210, that is, the acoustic signal, and at least a portion of the ambient noise at the speaker 210. The sampled portion includes a portion of ambient noise that is not attenuated by the body and physical enclosure of the headphone 202. In general, these microphone samples are fed back to the ANC processor 204, which produces anti-noise signals from the microphone samples and combines them with the headphone audio signal 216 to provide the ANC-compensated audio signal 218 to the headphone 202. The ANC-compensated audio signal 218, in turn, allows the speaker 210 to produce a noise-reduced audio output.

The tone source or tone generator 208, introduces or generates the tone signal 224 that is injected into the headphone audio signal 216. In some versions, the tone generator 208 generates the tone signal 224. In other versions, the tone source includes a storage location, such as flash memory, that is configured to introduce the tone signal 224 from a stored tone or stored tone information. Once the tone signal 224 is injected, the headphone audio signal 216 becomes a combination of the headphone audio signal 216 before the tone signal 224, plus the tone signal 224. Thus, processing of the headphone audio signal 216 after injection of the tone signal 224 includes both. Preferably, the resulting tone has a frequency at about the center frequency of a bandpass filter, which is discussed below. For example, the tone may have a frequency of between about 15 Hz and about 30 Hz. As another example, the tone may be a 20 Hz tone, and the level of the tone may be around −40 dBFS (decibels relative to full scale). In some implementations, a higher or lower frequency tone could be used. Also, the level of the tone could be greater or less than −40 dBFS, depending on the sensitivity of the ANC microphones. In these examples, 0 dBFS may be defined as the sine wave with the maximum level that can be played without any clipping, that is, without going over the range of the signal path. Under that definition, the amplitude of the −40 dBFS tone would be 1% of the amplitude of the 0 dBFS tone. Regardless of the particular frequency or tone level used, the tone, when played by the speaker 210, is preferably inaudible to human beings at the selected combination of frequency and level.

Some embodiments do not include the tone generator 208 or the tone signal 224. For example, if there is music playing, especially music with non-negligible bass, there may be sufficient ambient noise for the OED processor 206 to reliably determine whether the headphone 202 is on ear or off ear. In some embodiments, the tone or the tone signal 224 may not, if played by the speaker 210, result in an actual tone. Rather, the tone or the tone signal 224 may instead correspond to or result in a random noise or a pseudo-random noise, each of which may be bandlimited.

As noted above, in some versions of the off-ear detection system 200 it is not necessary to include or operate the speaker 210 and the feedforward microphone 212. For example, some embodiments include the feedback microphone 214 and the tone generator 208 without the feedforward microphone 212. As another example, some embodiments include both the feedback microphone 214 and the feedforward microphone 212. Some of those embodiments include the tone generator 208, and some do not. Embodiments not including the tone generator 208 also may or may not include the speaker 210.

Additionally, note that some embodiments do not require a measurable headphone audio signal 216. For example, embodiments that include the tone signal 224 may effectively determine whether or not the headphone 202 is being worn, even in the absence of a measurable headphone audio signal 216 from an audio source. In such cases, the tone signal 224, once combined with the headphone audio signal 216, is essentially the entire headphone audio signal 216.

In general, the off-ear detector uses signal processing in a relatively narrow spectrum, for example, around 20 Hz. Accordingly, the signal path preferably does not include a high-pass filter with a cutoff frequency higher than the narrow spectrum. Because of the narrow spectrum, the signal processing generally does not require a high sampling rate for the headphone audio signal 216, the feedforward microphone signal 220, or the feedback microphone signal 222. As such, decimation or another sample rate reduction technique may be used prior to the signal processing to reduce the sampling rate. For example, a 1 kHz sample rating might be used in some embodiments.

Figure 3:
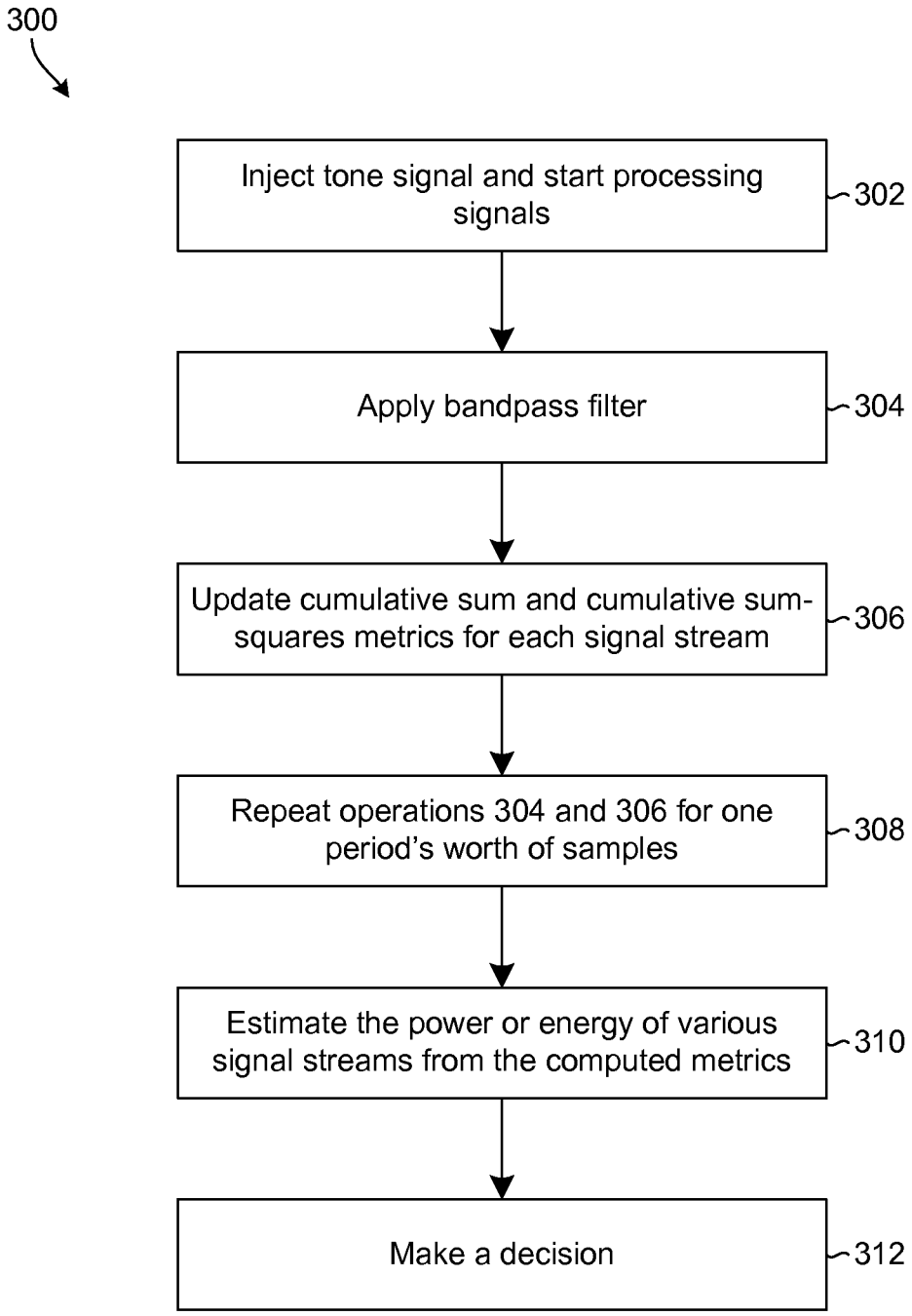
FIG. 3 is an example flow diagram illustrating operations for OED signal processing according to an embodiment of the invention.

FIG. 3 is an example flow diagram of an OED method 300 illustrating operations for signal processing, for example, by the OED processor 206 of FIG. 2, according to an embodiment of the invention.

Referring to both FIG. 2 and FIG. 3, at operation 302, the tone generator 208 injects the tone signal 224, and the OED processor 206 receives the feedforward microphone signal 220 and the feedback microphone signal 222. The tone generator 208 may fade the tone signal 224 in or out, or both, to make any transient effects inaudible to the listener. Preferably, the headphone audio signal 216, the feedforward microphone signal 220, and the feedback microphone signal 222 are available in bursts, with each burst containing one or more samples of the signals. As noted above for FIG. 2, the tone signal 224 and the feedforward microphone signal 220 are optional; so some embodiments of the method 300 do not include injecting the tone signal 224 or receiving the feedforward microphone signal 220.

The time domain ambient noise waveform correlation between the feedforward microphone signal 220 and feedback microphone signal 222 is better for narrowband signals than wideband signals. This is an effect of non-linear phase response of the headphone enclosure. Thus, at operation 304, a bandpass filter may be applied to the headphone audio signal 216, the feedforward microphone signal 220, and the feedback microphone signal 222. Preferably, the bandpass filter has a center frequency of less than about 100 Hz. For example, the bandpass filter may be a 20 Hz bandpass filter. Thus, the lower cutoff frequency for the bandpass filter could be around 15 Hz, and the upper cutoff frequency for the bandpass filter could be around 30 Hz, resulting in a center frequency of about 23 Hz. Preferably, the bandpass filter is a digital bandpass filter and may be part of the OED processor 206. For example, the digital bandpass filter could be four biquadratic filters: two each for the low-pass and the high-pass sections. In some embodiments, a low-pass filter may be used instead of a bandpass filter. For example, the low-pass filter may attenuate frequencies greater than about 100 Hz or, more preferably, greater than about 30 Hz. Regardless of which filter is used, the filter state is preferably maintained for each signal stream from one burst to the next. While not discussed in detail in this disclosure, the analysis may be performed in the frequency domain instead of in the time domain. If so, the bandpass filter is not necessary.

At operation 306, the OED processor 206 updates, for each sample, data related to the sampled data. For example, the data may include cumulative sum and cumulative sum-squares metrics for each of the headphone audio signal 216, the feedforward microphone signal 220, and the feedback microphone signal 222. The sum-squares are the sums of the squares.

At operation 308, operation 304 and operation 306 are repeated until the OED processor 206 processes a preset duration of samples. For example, the preset duration could be one second's worth of samples. Another duration could also be used.

At operation 310, the OED processor 206 determines a characteristic, such as the power or energy of one or more of the headphone audio signal 216, the feedforward microphone signal 220, and the feedback microphone signal 222, from the metrics computed in the previous operations.

At operation 312, the OED processor 206 assesses whether the headphone is off ear. For example, the OED processor 206 may compare the power or energy of one or more of the headphone audio signal 216, the feedforward microphone signal 220, and the feedback microphone signal 222 to one or more thresholds or parameters. The thresholds or parameters may correspond to one or more of the headphone audio signal 216, the feedforward microphone signal 220, or the feedback microphone signal 222, or the power or energy of those signals, under one or more known conditions. The known conditions may include, for example, when the headphone is already known to be on ear or off ear or when the OED tone is playing or not playing. Once the signal values, energy values, and power values are known for the known conditions, those known values may be compared to determined values from an unknown condition to assess whether or not the headphone is off ear.

The operation 312 may also include the OED processor 206 outputting a decision signal 226. The decision signal 226 may be based at least in part on whether the headphone 202 is assessed to be off ear or on ear.

Figure 4:
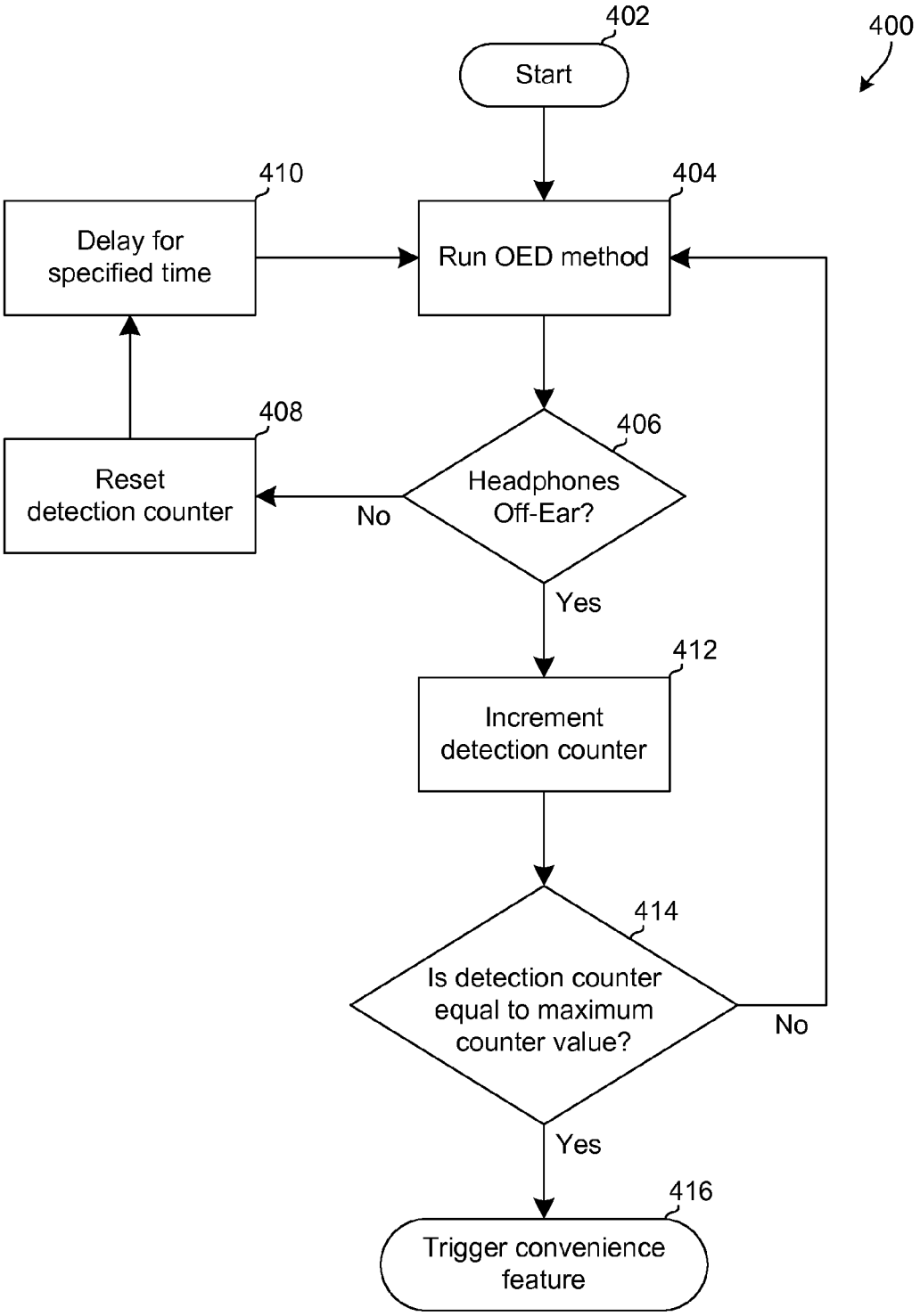
FIG. 4 is an example flow diagram illustrating an implementation of an OED method according to an embodiment of the invention.

FIG. 4 is an example flow diagram illustrating an implementation of an iterative method 400 according to an embodiment of the invention. The iterative method may be performed, for example by the OED processor 206 discussed above for FIG. 2.

The result from a single run of the OED method 300 described above accurately determines the headphone's status as being on ear or off ear with high probability, typically greater than 90%. To further reduce the probability of false alarms, however, the OED method 300 can be performed multiple times before triggering a convenience feature.

Thus, in the example process of FIG. 4, an iterative method 400 begins at operation 402 where a detection counter is set to zero. The process then moves to operation 404, where the OED method 300, such as described above for FIG. 3, is carried out. Each of the variations discussed above for FIG. 2 and FIG. 3 may also be available within the example process of FIG. 4.

In operation 406, the OED processor 206 assesses whether the headphone 202 is on ear or off ear. This corresponds to process 312 discussed above for FIG. 3. For example, the OED processor 206 may compare the power or energy of one or more of the headphone audio signal 216, the feedforward microphone signal 220, and the feedback microphone signal 222 to one or more thresholds or parameters, such as the thresholds or parameters discussed above for FIG. 3.

If the OED processor 206 determines that the headphone 202 is on ear, then the process exits operation 406 in the "no" direction to operation 408. At operation 408, the detection counter is reset to zero.

The process then moves from operation 408 to operation 410, where the process is optionally paused for a specified period of time. That is, for power efficiency the OED method 300 may be carried out at a reduced duty cycle by idling for a period of time if the OED processor 206 determines that the headphone 202 is currently being used, or on ear. For example, the reduced duty cycle could be about 20%. The process at operation 404 may take about one second to complete, if, for example, one second's worth of samples are to be collected. This is discussed above in operation 308 of FIG. 3. Accordingly, the delay period at operation 410 could be about four seconds to result in a reduced duty cycle of about 20%. After operation 410, the process returns to operation 404, where the OED processor 206 again carries out the OED method 300.

If, at operation 406, the OED processor 206 determined that the headphone 202 is off ear, then the process exits operation 406 in the "yes" direction to operation 412. At operation 412, the detection counter is increased by one, and the process moves to operation 414. At operation 414, the OED processor 206 compares the detection counter to a maximum counter value to decide whether the detection counter has reached the maximum counter value. Accordingly, the detection counter represents the number of consecutive times that the OED processor 206 made a "yes" decision, or assessment, at operation 406. The maximum counter value may be preset to require, for example, six consecutive "yes" decisions, or use other criteria.

If, at operation 414, the OED processor 206 determined that the detection counter is not equal to the maximum counter value, or other criteria, then the process exits operation 414 in the "no" direction and returns to operation 404. At operation 404, the OED processor 206 performs the OED method 300 again.

If, at operation 414, the OED processor 206 determined that the detection counter is equal to the maximum counter value, then the process exits operation 414 in the "yes" direction to operation 416. At operation 416, a convenience feature is triggered. For example, the ANC processor 204 might generate a signal that, when received by another component, such as another processor or a switch, might initiate one or more of the convenience features. As noted above, examples of such convenience features include turning off the ANC features, turning off parts of the headphone, turning off the entire headphone, pausing or stopping the media player, or another power-saving measure.

In some versions, the process at operation 404 does not include injecting the tone signal 224 for the first J iterations, where J is an integer having a value no less than zero and, preferably, no greater than the maximum counter value. Thus, for example, if the maximum counter value is eight, J could be set to three, such that the first three iterations of operation 404 do not include injecting the tone signal 224 while the remaining five iterations would include injecting the tone signal 224. This version might help to minimize intrusion caused by the tone signal 224 during normal use of the headphone 202.

In a variation of the example process of FIG. 4, the "yes" and "no" exits of operation 406 could be reversed, such that a "yes" exits operation 406 to operation 408 and a "no" exits operation 406 to operation 412. In such versions, the detection counter represents the number of consecutive times that a "no" decision, or assessment, was made at operation 406. Accordingly, this version could be used to iteratively detect when the headphone 202 is on ear. In such a variation, the convenience feature might include starting or restarting the audio play, for example, by sending a signal to the media player. If audio may already be playing, the convenience feature might also include a check of whether the headphone audio signal 216 is currently being received by the OED processor 206 before starting or restarting the audio play.

Embodiments of the invention may operate on a particularly created hardware, on firmware, Digital Signal Processors, or on a specially programmed general purpose computer including a processor operating according to programmed instructions. The terms "controller" or "processor" as used herein are intended to include microprocessors, microcomputers, ASICs, and dedicated hardware controllers. One or more aspects of the invention may be embodied in computer-usable data and computer-executable instructions, such as in one or more program modules, executed by one or more computers (including monitoring modules), or other devices. Generally, program modules include routines, programs, objects, components, data structures, etc. that perform particular tasks or implement particular abstract data types when executed by a processor in a computer or other device. The computer executable instructions may be stored on a non-transitory computer readable medium such as a hard disk, optical disk, removable storage media, solid state memory, RAM, etc. As will be appreciated by one of skill in the art, the functionality of the program modules may be combined or distributed as desired in various embodiments. In addition, the functionality may be embodied in whole or in part in firmware or hardware equivalents such as integrated circuits, field programmable gate arrays (FPGA), and the like. Particular data structures may be used to more effectively implement one or more aspects of the invention, and such data structures are contemplated within the scope of computer executable instructions and computer-usable data described herein.

The previously described versions of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this disclosure to a method having two or more defined steps or operations, the defined steps or operations can be carried out in any order or simultaneously, unless the context excludes those possibilities.

Furthermore, the term "comprises" and its grammatical equivalents are used in this disclosure to mean that other components, features, steps, processes, operations, etc. are optionally present. For example, an article "comprising" or "which comprises" components A, B, and C can contain only components A, B, and C, or it can contain components A, B, and C along with one or more other components.

Although specific embodiments of the invention have been illustrated and described for purposes of illustration, it will be understood that various modifications may be made without departing from the spirit and scope of the invention. Accordingly, the invention should not be limited except as by the appended claims.

What is claimed is:

1. A headphone detector comprising:

a headphone having a microphone and a speaker, the microphone configured to generate an audio signal based on an output of the speaker, in which the microphone includes a feedback microphone configured to sample the output of the speaker;

a processor configured to receive the audio signal, determine a characteristic of the audio signal, and assess whether the headphone is on ear or off ear based on a comparison of the characteristic to a threshold; and a feedforward microphone configured to generate an ambient noise signal based on a sampled ambient noise level, in which the processor is further configured to receive the ambient noise signal, determine a characteristic of the ambient noise signal, and assess whether the headphone is on ear or off ear further based on a comparison of the characteristic of the ambient noise signal to a parameter, wherein the threshold and parameter correspond to one or more of an audio response of the audio signal at a corresponding frequency, an audio response of the ambient noise signal at a corresponding frequency, and an audio response of a feedback microphone signal at a corresponding frequency, under one or more known conditions.

2. The headphone detector of claim 1, further comprising a tone source configured to produce a tone in the output of the speaker.

3. The headphone detector of claim 2, in which a signal generated by the tone source is mixed with the audio signal.

4. The headphone detector of claim 1, in which the characteristic of the audio signal is an energy of the audio signal.

5. The headphone detector of claim 1, in which the characteristic of the audio signal is an energy of a portion of the audio signal.

6. The headphone detector of claim 1, in which the characteristic of the audio signal is an energy of a low-frequency portion of the audio signal.

7. The headphone detector of claim 1, in which the threshold relates to a known condition of the headphone.

8. A method of detecting whether a headphone is off ear or on ear, the method comprising:

producing an acoustic signal at a headphone based at least in part on a received headphone audio signal;

generating, at the headphone, a feedforward microphone signal and a feedback microphone signal, in which the feedback microphone signal is based at least in part on the acoustic signal;

determining, with the processor, a characteristic of the headphone audio signal, a characteristic of the feedforward microphone signal, and a characteristic of the feedback microphone signal, wherein the characteristics include an audio response at a corresponding frequency; and assessing, with the processor, whether the headphone is off ear or on ear based at least in part on an audio response of the headphone audio signal, an audio response of the feedforward microphone signal, and an audio response of the feedback microphone signal.

9. The method of claim 8, further comprising injecting a tone signal into a headphone audio signal.

10. The method of claim 8, further comprising applying a bandpass filter to the headphone audio signal, the feedforward microphone signal, and the feedback microphone signal before determining the characteristics, the bandpass filter having a center frequency of less than 100 Hz.

11. The method of claim 8, further comprising iteratively receiving, at the processor, the headphone audio signal, the feedforward microphone signal, and the feedback microphone signal until a preset duration of samples is obtained.

12. The method of claim 11, in which determining the characteristics includes determining:

a running sum for each of the headphone audio signal, the feedforward microphone signal, and the feedback microphone signal;

a running sum of squares of the headphone audio signal, the feedforward microphone signal, and the feedback microphone signal; and a running sum of products of the feedforward microphone signal times the feedback microphone signal.

13. The method of claim 8, further comprising outputting a decision signal from the processor, in which the decision signal is based at least in part on whether the headphone is assessed to be off ear or on ear.

14. The method of claim 13, further comprising triggering a convenience feature based at least in part on the decision signal.

15. The method of claim 14, in which the convenience feature includes sending a signal to initiate a power-saving feature.

16. The method of claim 14, in which the convenience feature includes sending a signal to stop a media player from generating the headphone audio signal.

17. The method of claim 14, in which the convenience feature includes sending a signal to start a media player, the media player generating the headphone audio signal.

18. The method of claim 8, further comprising iteratively performing the generating, determining, and assessing processes until a preset number of identical, consecutive assessments is obtained.

19. The method of claim 18, further comprising a delay period between each iteration, the delay period being substantially longer than a duration of time for performing one iteration of the generating, determining, and assessing processes.

20. The method of claim 18, further comprising injecting a tone signal into a headphone audio signal for each iteration after a preset number of iterations.

21. The method of claim 8, in which determining the characteristics includes determining an energy of the headphone audio signal, an energy of the feedforward microphone signal, and an energy of the feedback microphone signal.

22. The method of claim 8, in which determining the characteristics includes determining a power of the headphone audio signal, a power of the feedforward microphone signal, and a power of the feedback microphone signal.

* * * * *